US007194388B2

(12) United States Patent
Chu et al.

(10) Patent No.: US 7,194,388 B2
(45) Date of Patent: Mar. 20, 2007

(54) METHOD FOR DETERMINING A DIE PROFILE FOR FORMING A METAL PART HAVING A DESIRED SHAPE AND ASSOCIATED METHODS

(75) Inventors: Edmund W. Chu, Export, PA (US); Stephen J. Makosey, Sagamore Hills, OH (US); Jeffrey M. Shoup, Delmont, PA (US)

(73) Assignee: Alcoa Inc., Pittsburgh, PA (US)

( * ) Notice: Subject to any disclaimer, the term of this patent is extended or adjusted under 35 U.S.C. 154(b) by 918 days.

(21) Appl. No.: 10/105,578

(22) Filed: Mar. 25, 2002

(65) Prior Publication Data

US 2003/0182005 A1 Sep. 25, 2003

(51) Int. Cl.
*G06F 17/10* (2006.01)

(52) U.S. Cl. ..... 703/2; 703/7; 700/178

(58) Field of Classification Search ..... 703/2, 703/6, 7; 700/178
See application file for complete search history.

(56) References Cited

U.S. PATENT DOCUMENTS

| | | | | |
|---|---|---|---|---|
| 4,802,357 A | * | 2/1989 | Jones | 72/17.3 |
| 4,989,439 A | * | 2/1991 | Ewert et al. | 72/372 |
| 5,463,558 A | | 10/1995 | Tang et al. | |
| 5,508,935 A | * | 4/1996 | Pourboghrat | 700/97 |
| 5,546,784 A | | 8/1996 | Haas et al. | |

FOREIGN PATENT DOCUMENTS

| | | |
|---|---|---|
| EP | 0417311 | 3/1991 |
| WO | WO/02/025503 | 3/2002 |

OTHER PUBLICATIONS

Livatyali et al., H. Prediction and Elimination of Springback in Straight Flanging Using Computer Aided Design Methods: Part 1. Experimental Investigations, Journal of Materials Processing Technology, vol. 117, Nov. 2001, pp. 262-268.*

Livatyali et al., H. Prediction and Elimination of Springback in Straight Flanging Using Computer-Aided Design Methods: Part 2: FEM Predictions and Tool Design, Journal of Materials Processing Technology, vol. 120, Jan. 2002, pp. 348-354.*

(Continued)

*Primary Examiner*—Russell Frejd
(74) *Attorney, Agent, or Firm*—Greenberg Traurig LLP; Peter J. Borghetti

(57) ABSTRACT

A method for determining a die profile for forming a metal part having a desired shape. The method includes the steps of providing a nominal die profile, determining a springback profile based on the nominal die profile and employing a compensation strategy to determine the die profile based on the nominal die profile and the springback profile. There are disclosed five (5) compensation strategies: (1) a reversed die-normal technique; (2) a reversed radial rotation technique; (3) a reversed resultant vector technique; (4) a reversed path technique; and (5) a mirror image of resultant vector technique. Associated methods of making a die based on the die profile determined above and making a metal part under a set of forming conditions from the die are also disclosed.

13 Claims, 8 Drawing Sheets

OTHER PUBLICATIONS

Samuel, M. Experimental and Numerical Prediction of Springback and Side Wall Curl in U-Bendings of Anisotropic Sheet Metals, Journal of Materials Processing Technology, vol. 105, Sep. 2000, pp. 382-393.*

Karafillis, A.P. et al., Tooling Design in Sheet Metal Forming Using Springback Calculations, International Journal of Mechanical Science, vol. 34, No. 2, pp. 113-131, 1992, Printed in Great Britain.

Karafillis, A.P., et al., Tooling and Binder Design for Sheet Metal Forming Process Compensating Springback Error, Submitted to Intl. Journal of Machine Tools and Manufacture, pp. 1-47, Jun. 6, 1994, Dept. of Mechanical Engineering, MA Institute of Technology, Cambride, MA 02139, USA.

Pourboghrat, Farhang, et al., Springback in Plane Strain Stretch/Draw Sheet Forming, Intl. Journal of Mechanical Science, vol. 36, No. 3, pp. 327-341, 1995.

* cited by examiner

METHOD FOR DETERMINING A DIE PROFILE FOR FORMING A METAL PART HAVING A DESIRED SHAPE AND ASSOCIATED METHODS

BACKGROUND OF THE INVENTION

This invention relates to a method for determining a die profile for forming a metal part having a desired shape and associated methods. The shape of the die profile is made to compensate for the springback behavior of the materials that are used to form the desired product shape after forming, trimming or sub-assembly.

Die design, for many years, has been achieved by designers using trial and error, intuition and experience. This accumulated knowledge and experience is effective when dealing with a known material, such as mild steel. However, problems arise when new materials, such as high strength steel or aluminum are desired to be formed. When using these new materials, the old "rules of thumb" and the accumulated wisdom and experience of the designer sometimes prove to be ineffective. Furthermore, it is also time consuming and cost prohibitive to use this trial-and-error procedure for die development.

There are efforts now to make die design more of a "science" than an "art". This involves using mathematical models and the mechanical properties of the metal which are used in the part, in combination with the formation process used to make the part, to give designers a better idea of the final design. With the new generation of automotive materials mentioned above, it is crucial to optimize die design, as uncompensated dies, if manufactured, are expensive and time-consuming to fix or replace and to minimize part springback to within acceptable tolerances. For example, it is estimated, for some dies, that "tool recuts" can cost more than a half-million dollars. It has been known that some complicated dies have to be recut five or more times. Obviously, this is a large cost item that must be avoided.

What is needed, therefore, is a method of making a die for forming a desired metal part that compensates for springback. The die should produce metal parts within a stated tolerance in critical regions within the part surface, and should do so with zero or a minimum of "tool recuts".

SUMMARY OF THE INVENTION

The invention has met or exceeded the above-mentioned needs. The method comprises the steps of providing a nominal die profile, determining a springback profile based on the nominal die profile and employing a compensation strategy to determine the die profile based on the nominal die profile and the springback profile. There are disclosed five (5) compensation strategies: (1) a reversed die-normal technique; (2) a reversed radial rotation technique; (3) a reversed vector technique; (4) a reversed path technique, and (5) mirror image of resultant vector technique.

Associated methods of making a die based on the die profile determined above and making a metal part under a set of forming conditions from the die are also disclosed.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
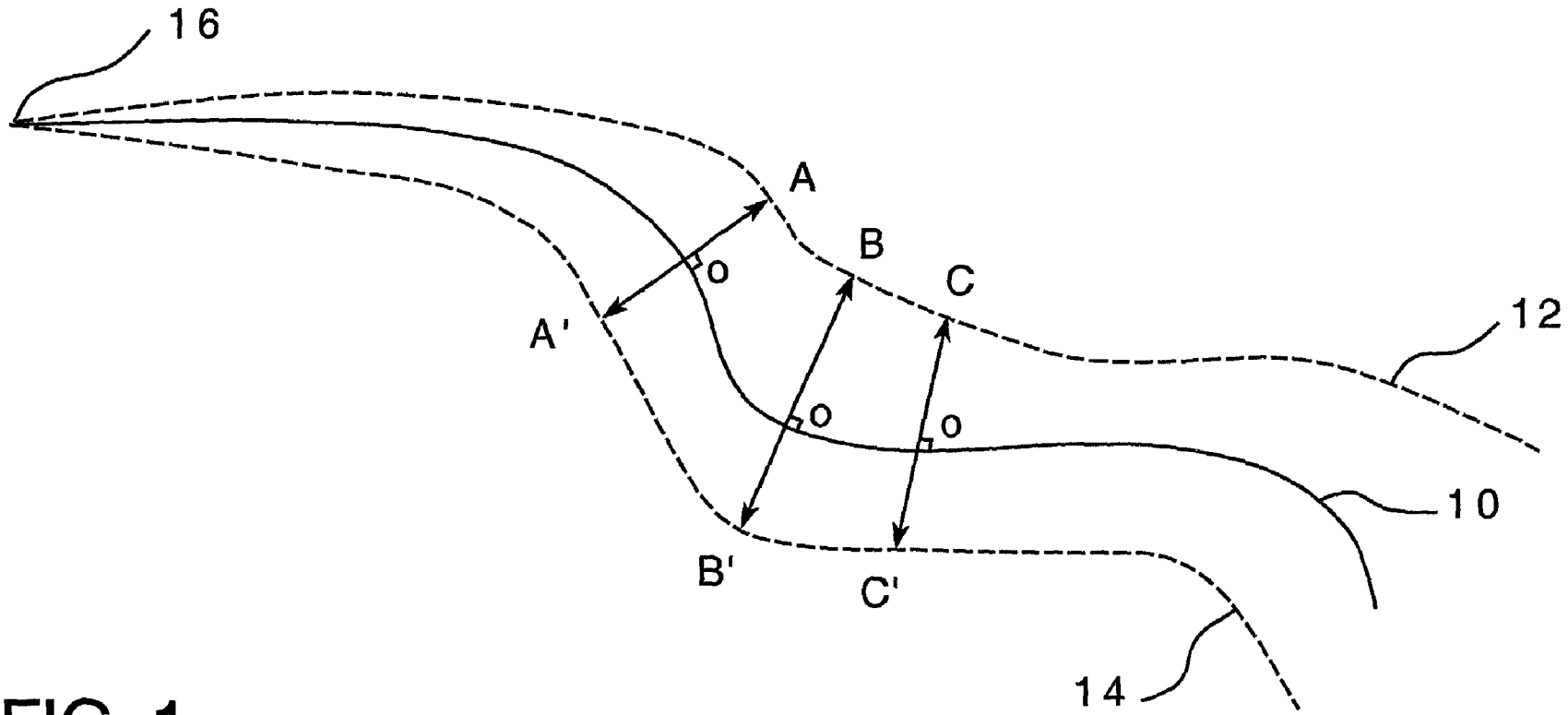
FIG. 1 is a graphical representation showing details of the first compensation strategy, the reversed die-normal projection technique.

In order to make two-dimensional and three-dimensional metal parts, such as parts for transportation uses (such as automobiles) a die must be made which will be used to stamp the metal which forms the part. Traditionally, automobile parts have been made with steel, and there was more than a century of design and forming experience that had been built up with regard to die designs. That is, die designers, through experience, knew how to design a die profile for a desired part that would compensate for springback of the part after stamping. With the ever-increasing use of other metals, such as aluminum, for stamped automotive parts, the experience of steel was not as relevant, and new strategies had to be undertaken. The old "rules of thumb" were not relevant. Due to the expense of making and recutting dies, it is desired to make the die profile design as scientific as possible.

It will be appreciated that the method of this invention can be used with any formable metals, such as, for example, aluminum, ultra light high strength steel, magnesium, and titanium. The compensation strategies disclosed are robust, and can be used for two-dimensional and three-dimensional modeling.

Typically, a product designer will approach a die designer with a design for a part that needs to be created. The product designer may or may not have all the necessary features for the die design, such as binder and addenda features. Generally, the binder and addenda are portions of the part features, located outside the part trim line, that are designed to enhance part performance and generate more uniform strain distributions over the entire surface of the product. Based on his/her knowledge, the die designer would develop the draw die including all these part features required for forming a producible part. This is the first representation of a nominal die design. Again, the draw die developed may vary with material being used for the part. Therefore, knowledge of the mechanical properties of the material behavior is important for designing an initial draw die appropriately.

Once the nominal die design is provided as discussed above, the method of the invention then provides for determining a springback profile based on the nominal die profile. This step is usually done by utilizing a computer and a computer program. The computer program typically involves a finite element analysis (FEA) or a finite element model which takes into account the following properties of the material that is desired to be used: (i) stress/strain data; (ii) work hardening coefficient; (iii) plastic ansiotropic ratio and yield stress in the 0°, 45° and 90° orientations with respect to the material rolling direction and (iv) appropriate yield criterion for the desired metal. The FEA process is a known process, and the data needed is publicly available for the commonly used automotive materials or the material data can be generated using well known mechanical testing procedures available in the industry. Several software programs, such as those sold commercially under the trade names ABAQUS, LS-DYNA3D/LS-NIKE3D, OPTRIS or PAMSTAMP can be used to determine the springback profile.

The above step will also determine whether the metal is indeed formable into the desired part. Of course, if the metal is not formable, changes to the part must be made. Otherwise, it is meaningless to talk about springback and springback compensation.

Once the springback profile is determined, the invention provides for five (5) compensation strategies or techniques to determine the compensated die profile based on the nominal die profile and the springback profile. These will be discussed below.

A first compensation strategy is called "reversed die-normal projection technique". It will be appreciated that this strategy can be applied locally (to selective regions of a die) or globally (over the entire surface of the die). In this strategy, springback can be calculated as the distance of the normal vectors from the nominal die surface to the predicted springback part surface. The compensated die shape is the normal projection of these vectors at every point on the die surface, measured in the opposite direction of the die. Scalar factors of 100%, 110%, 120% or any desired percentage can be used, although normally a scalar factor between 110% and 125% is used. The "reversed die-normal projection technique", consistent with the method of the invention, is determined based on predictive modeling capability coupled with an understanding of the aluminum material behavior.

Referring to FIG. 1, an example of how the reversed die-normal projection technique is shown. A portion of the nominal die profile 10 is shown, with the springback profile 12, as determined by the FEA model, also shown superimposed over the nominal die profile. The center plane of symmetry is indicated at 16. Generally, the nominal die profile can be represented either by the CAD surface data or the nodal coordinates (x, y, z) of a finite element mesh in a FEA model. The surface normal at every location of the surface can then be generated by a computer using either the surface data or the coordinates of the mesh. As an example shown in FIG. 1, three surface normal vectors, OA, OB, and OC were created. Each normal vector will have a magnitude and a direction indicating where the vector will touch the springback profile 12. The magnitude of the vector, say OA, can then be determined by its nodal coordinates and the direction of the vector is governed by its normality at point O on the desired shape 10. Following the same procedure, for all other vectors, such as OB and OC, the entire springback profile will be represented by an array of normal vectors or points represented by the end points of the normal vectors. To determine the compensated die profile, these vectors are either reversed directly with the same magnitudes or they are multiplied by a scalar (initially either 1.00 or 1.10) and then reversed to determine the points on that will represent the compensated die profile 14. OA now becomes OA', OB becomes OB', and OC becomes OC' (OA' being equal to 1.15*OA, OB' being equal to 1.15*OB, and OC' being equal to 1.15*OC, etc . . . ). Subsequently, these reversed vectors will form compensated die profiles 14.

The compensation strategies discussed herein can either be applied to a selected region(s) of a die (local compensation) or be applied over the entire surface of the original die (global compensation). When a local compensation strategy is used, more interactions may be required since interactions between neighboring surfaces may be a determining factor in the process. Neighboring surfaces do interact with one another. The uncompensated areas may see a slight change in the springback values as a result of changes in the adjacent surfaces. According to the invention, in order to determine whether a local or global compensation approach should be used (given a tolerance requirement (initially, +/−1 mm)), the criteria are as follows: (1) If 70% or more of the resultant part shape is within the tolerance requirement, then the local compensation approach should be used. (2) If 30% or less of the resultant part shape is within the tolerance requirement, then the global compensation approach should be used.

A second compensation strategy is the "reversed radial rotation technique". In this technique, circular slides are sectioned away from a pre-determined center origin of the part, and the radial distance can be established based on the magnitude of such radial slide. In this case, the springback compensation technique is constructed based on the reversed rotation of a radial distance between the nominal die surface and the predicted springback shape of the part.

Figure 2:
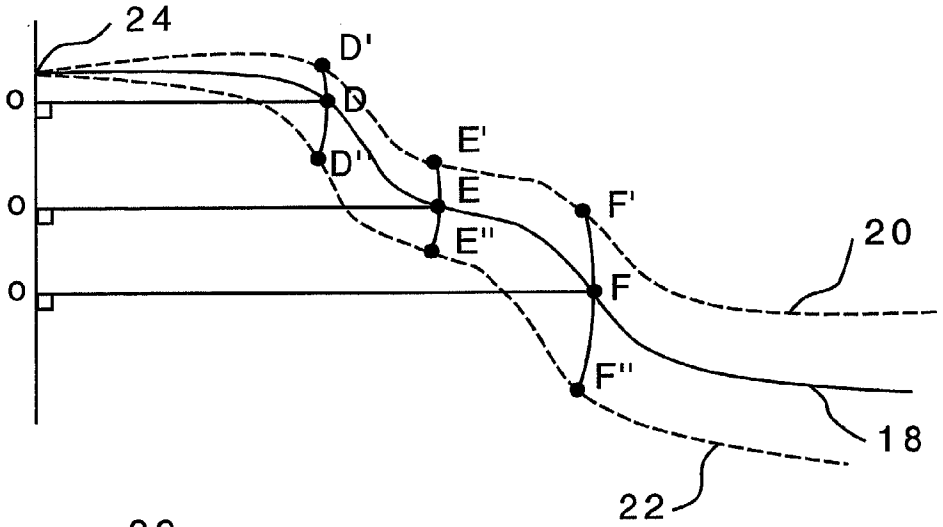
FIG. 2 is a graphical representation showing details of the second compensation strategy, the reversed radial rotation technique.

Again, the nominal die profile 18 is represented either by the CAD surface data or the nodal coordinates (x, y, z) of a finite element mesh in a FEA model. Circular slides are represented by radial distances from the center of a plane 24 as shown in FIG. 2. The magnitude of a radial distance can be established based on the distant from the center origin of the part 24 to the position of the nominal die profile 18. As an example, these radial distances are identified by OD, OE, and OF in FIG. 2. Point D, E, and F are established, respectively, at the end point of each radial vector. These points can be calculated based on the intersections between the original surface 18 and the radii specified for the slides. The rotation of each radius from the nominal die surface to the springback profile will give a relative measure of the amount of springback between the nominal and the springback profiles. For instance, a rotation of OD will give arc DD', a rotation of OE will give arc EE', and a rotation of OF' will give arc FF'. A representation of the springback profile 20 is achievable entirely based on such a sequence. The compensated die profile 22 can be constructed by a reversed radial rotation of all radial slides that generate arcs DD', EE', FF' and so on. Therefore, a rotation of the radius OD in the reverse direction will give arc DD". Similarly, OE' in the reverse direction will give EE", and becomes FF" and so on until the entire compensated surface profile is being generated. As discussed the previous strategy, magnitudes of the reversed arc lengths can be determined by multiplying the magnitudes of the original arcs by a scalar factor (initially can be either 1.00 or 1.10). The decision to perform whether a local or global compensation approach on the nominal surface profile depends on the criteria defined previously. If the overall predicted springback amount is 70% greater than or equals to the tolerance requirement, the local compensation approach is used. Otherwise use the global compensation approach. Once the decision is made, the compensation strategy can be applied the same way as described previously.

A third compensation strategy is the "reversed resultant vector technique". In this technique, the predicted springback is measured by the nodal coordinates of a defined mesh. The location of each node is describable by its position vector after the deformation. Therefore, the compensated die shape can be established using these nodal vectors, but measured in the spring-forward direction of the mesh with respect to the surface of the nominal die. Again, scalar factors of any desirable percentage can be used to modify the compensation amount on the die surface. Unlike other techniques, this strategy basically remaps the predicted deformation of the mesh proportional in the reversed direction of the die. This is done either locally or globally in order to develop a compensated die shape.

Figure 3:
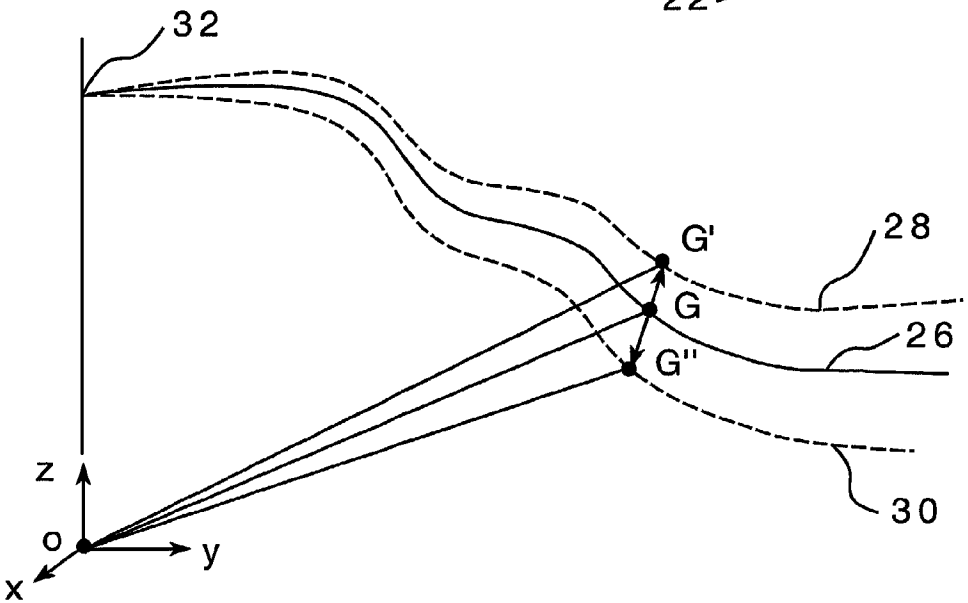
FIG. 3 is a graphical representation showing details of the third compensation strategy, the reversed vector technique.

Again, it is assumed that the nominal die profile is represented either by the CAD surface data or the nodal coordinates (x, y, z) of a finite element mesh in a FEA model. FIG. 3 indicates that a point on the nominal surface can be represented by its position vector (initially OG) and the part center is defined by the plane 32. After the deformation, this same point is determined from the original mesh data obtained from the FEA model, springback to the location G' on the springback profile, and its position vector becomes OG'. The magnitude and direction of the resultant vector, GG', are calculated by the difference of the two vectors OG' and OG. That is GG'=OG'−OG. Again, a scalar factor of initially 1.00 or 1.10 can be used to determine the magnitude of the reversed resultant vector GG". The compensated die profile is determined by the reversed resultant vectors such as GG" which is determined by the negative direction of resultant vector GG' and thus OG" defines the resultant position vector of point G" on the compensated die surface. All other points on the compensated die surface 30, that were originally on the nominal die surface 26 which are now located in the springback surface 28, can be determined with the exact same procedures described here. The decision to use either a local or global compensation approach to define a compensated die profile depends on how well the overall predicted amount of springback would fall within the tolerance requirement. It was defined before that the local compensation approach would be used if the prediction has 70% or more of points fall within the limits, while the global compensation would be adopted otherwise. Once the decision is made, the compensation strategy can be applied the same way as described previously.

A fourth compensation strategy is the "reversed path technique". Basically, during springback of a sheet component, each node of a finite element mesh will follow a substantially different path. This compensation strategy involves tracking of the path of each of these nodes during the springback phase of the forming process. A unique resulting path curve would be developed for each node in the model. These path curves would then be extended from their initial die surface locations, following their same general curvature, in the direction opposite the springback direction. Compensated die contour coordinate points would be generated by following these individual extended path curves by a predetermined compensation factor. Surface generation through these coordinate points results in the compensated die shape.

Figure 4:
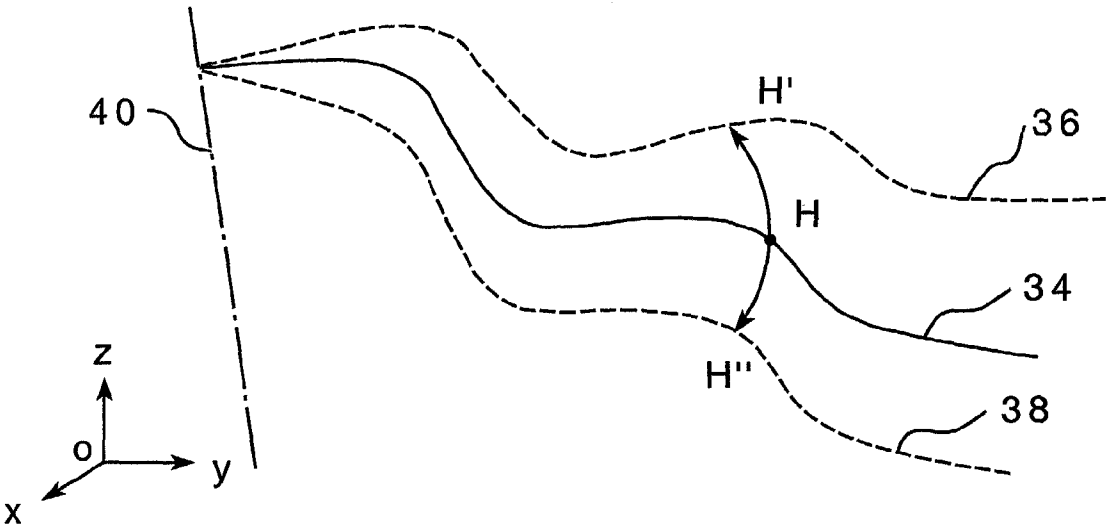
FIG. 4 is a graphical representation showing details of the fourth compensation strategy, the reversed path technique.

Generally, the nominal die profile is representable by either the CAD surface data or the nodal coordinates (x, y, z) of a finite element mesh in a FEA model. FIG. 4 shows a point, initially at location H on the nominal die surface 34, is springback to the location, H', on the springback profile 36, with point H' being determined from the original mesh data obtained from the FEA model. As it is being springback, point H follows the trajectory of H'. This path or trajectory is unique and may differ for each material point on the surface of a part. The path for each material point on the nominal die 34 can be traced by a FEA model that simulates the springback process. Once the path HH' is defined, it would then be extended from point H, following the same general curvature in the direction opposite the springback direction of the part, resulting in the location H" on the compensated die surface 38. To determine the final location of the point H" on the compensated die profile 38, all or part of the path HH' can be multiplied by a predetermined scalar factor (initially either 1.00 or 1.10). Subsequently, all material points on the die surface are generated in the like manner resulting in the die profile 38. Now, to decide whether a local or global compensation approach should be used to define a compensated die profile depends on how well the overall predicted springback amount would fall within the tolerance requirement. It was defined before that the local compensation approach would be used if the prediction has 70% or more of points within tolerance, while the global compensation would be adopted if otherwise. Once the decision is made, the compensation strategy can be applied the same way as described in this paragraph.

A fifth compensation strategy is the "mirror image of resultant vector technique". It is a variation of the third strategy discussed previously. In this technique, the predicted springback is measurable by the nodal coordinates of a finite element mesh. The location of each node is describable by its position vector before and after the deformation. A local tangent vector can be defined at each node and the mirror image of a resultant vector about the tangent vector gives a possible position of a node on a compensated die. Therefore, the compensated die shape can be established using mirror images of these resultant vectors, but measured in the reflected direction from the local tangent vectors on the surface of the nominal die. Again, scalar factors of any desirable percentage can be used to modify the compensation amount on the die surface. This is done either locally or globally in order to develop a compensated die shape.

Figure 5A:
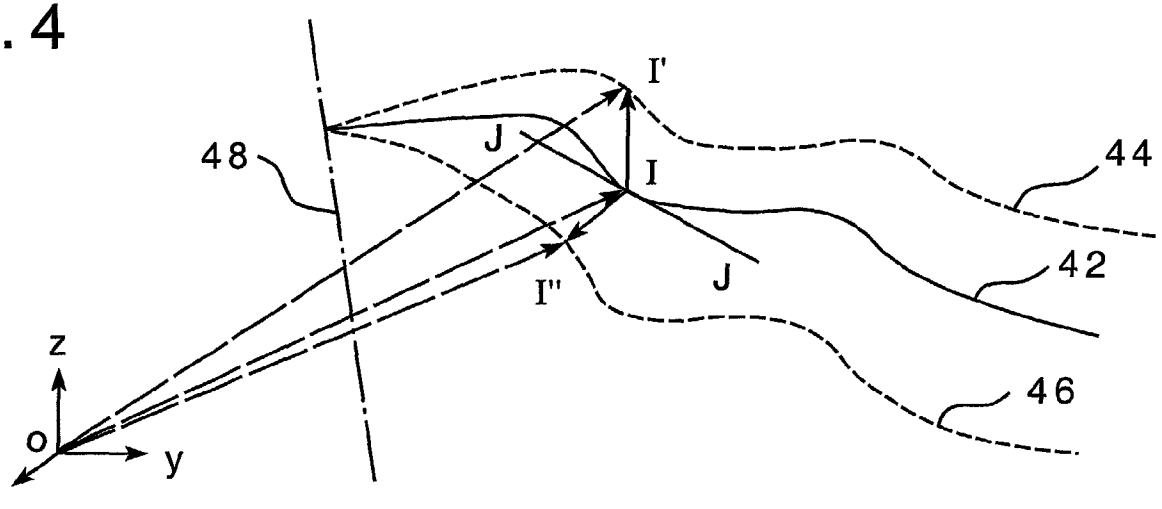
FIG. 5A is a graphical representation showing details of the fifth compensation strategy, the mirror image of resultant vector technique.

Assuming that the nominal die profile is representable by either the CAD surface data or the nodal coordinates (x, y, z) of a finite element mesh in a FEA model, FIG. 5A illustrates how this compensation technique is applied. Following the same aforementioned description regarding the third compensation strategy, the same point, I, describable by the position vector OI, initially on the nominal die profile 42, is now located in the springback profile 44 represented by I' and the die profile 46 represented by I" at different times can be easily described by the position vectors OI' and OI", respectively. The magnitude and direction of the resultant vector is defined by the vector II'=OI−OI. A local tangent line JJ through point I is then provided. The compensation strategy involves generating a mirror image of the resultant vector II", such that the angle JII' is equal in magnitude to the angle JII". The direction of the vector II" is defined by the angle JII" and its magnitude is determined by multiplying the magnitude of the vector II' by a scalar factor (initially either 1.00 or 1.10) that defines a point on the compensated die surface 46. Following the same approach outlined herein, the rest of the points on the compensated die surface 46, that were originally on the nominal die profile 42 which are now located in the springback profile 44, can be identified mathematically. To decide whether to apply a local or global compensation approach for defining a compensated die profile depends on how well the overall predicted amount of springback would lie within the tolerance requirement. It was defined previously that the local compensation approach will be used if 70% or more of the predicted springback points fall within the limits, while the global compensation would be adopted otherwise. Once the decision is made, the compensation strategy can be applied in the same manner described herein.

It will be appreciated that two or more compensation strategies can be used on the same part.

EXAMPLE

It was desired to obtain a metal product shape by defining the required die shape and forming process which delivers part tolerance of ±2 mm relative to the nominal design on a single 2D curvature part design. The purpose of this study was to evaluate a method of compensating for springback and to fiber validate the accuracy of the finite element analysis (FEA) used to model the forming process. For the first portion of the study, the die profiles were cut to the desired nominal shape and a series of parts were formed. It will be appreciated that in the method of the invention, this step of actually creating the nominal die tool and, then making parts is not required, and is, in fact, desired to be eliminated. In this example, however, it was desired to test the method using a real die profile and real parts, as opposed to these items being modeled on a computer.

The shapes of the parts after springback were measured with a coordinate measurement machine (CMM) and based on a comparison with the nominal shape, a compensated shape was developed and evaluated with the FEA. Once an acceptable compensated shape was obtained, a new punch and die were cut and a new series of parts were formed. The compensated shape proved to be successful with the maximum deviation from nominal being +/−1.75 mm in the Z-direction, well within the goal of +/−2 mm. However, it is within +/−1 mm tolerance deviation when measured normal to the part from the nominal surface.

Figure 5:
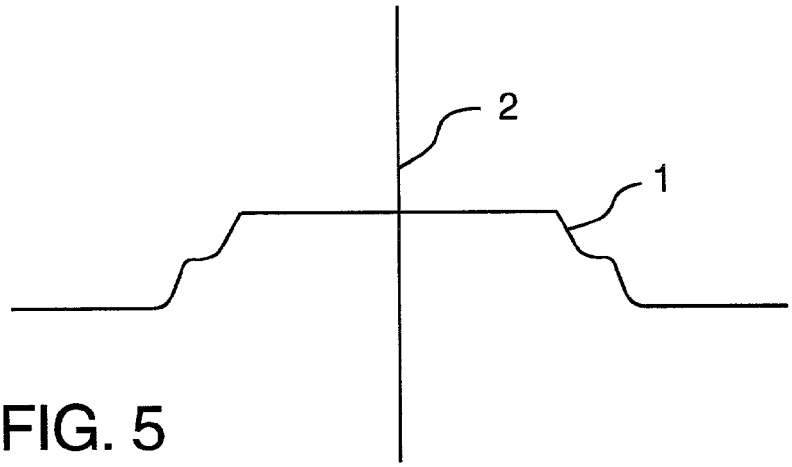
FIG. 5 is a drawing of the nominal part profile made in the EXAMPLE.
Figure 6:
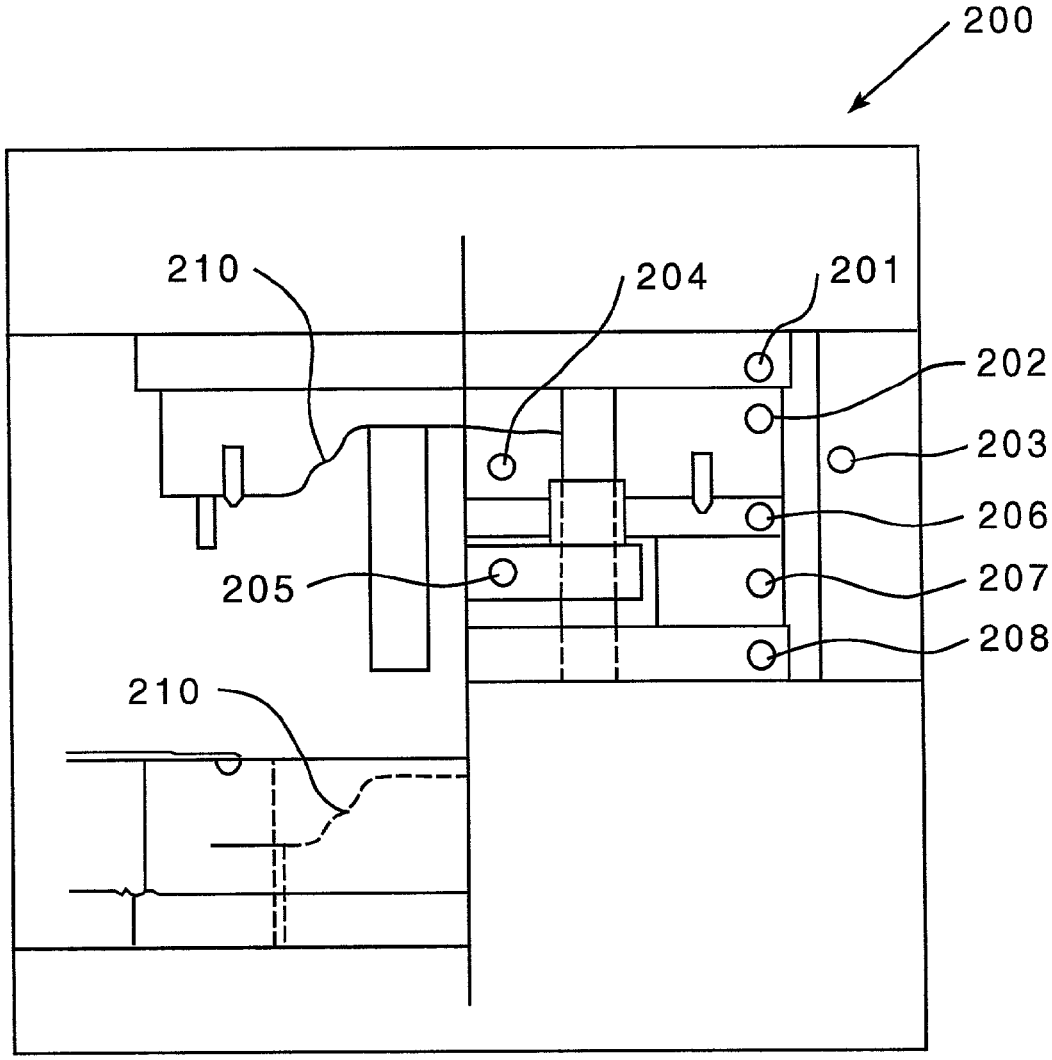
FIG. 6 is an open/closed split drawing of the toolset used in the EXAMPLE.

Experimental Part:

The experimental part is prismatic in shape with curvature in two dimensions. An illustration of the nominal geometry of part 1 is given in FIG. 5. The midplane is indicated at line 2. The tools used to form this part were carefully designed and manufactured to produce repeatable experimental results with precise guidance of the punch, die and binder. FIG. 6 shows an open/closed split drawing of the toolset. As is known, the toolset 200 includes a die shoe 201, a die 202, a drawbead 203 and a punch 204. The toolset 200 further includes a binder 206, binder spacer 207 and a binder shoe 208. The die has a nominal die profile shown by the reference number 210. The tools that contacted the aluminum sheet material were ground from tool steel through-hardened to 58–62 Rc. The sheet material used was 0.91 mm thick 6111-T4 with the rolling direction oriented across the width of the 304.8 mm wide by 482.6 mm long blanks. The tools were ground to allow +/−0.51 mm clearance relative to the nominal mid-plane profile. Drawbeads with a 10 mm radii set to a depth of 10 mm were used to restrain the sheet at each end. The binder surface was offset with 1.27 mm shims so restraint was provided exclusively by the action of the drawbeads. The petroleum-based lubricant used was Macstamp 95-817, supplied by Fuchs Lubricant Company. The coefficient of friction was measured to be 0.17 along the roll direction and 0.13 transverse to the roll direction with the drawbead simulation (DBS) test. The appropriate value of the coefficient of friction was used in the FEA simulation. Each sheet was wiped clean with isopropyl alcohol and Tubed before being placed in the toolset. The toolset was cleaned and lubricated before the first blank was formed and not touched for the remainder of the series. The CMM measurement involved placing the parts convex upward on three pins that provided support at locations +/−75 mm from the center plane of symmetry. Adjustable pins were then used to support the outermost ends of the parts so they would not deflect under contact with the CMM probe.

Figure 7:
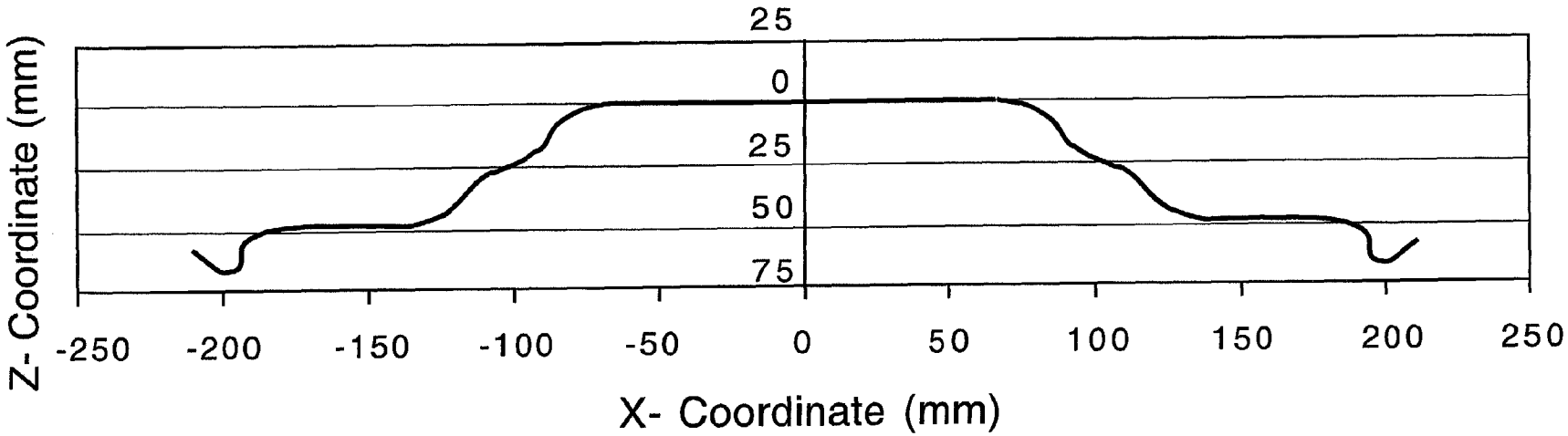
FIG. 7 is a graph showing the shapes of ten parts made by the nominal die.
Figure 8:
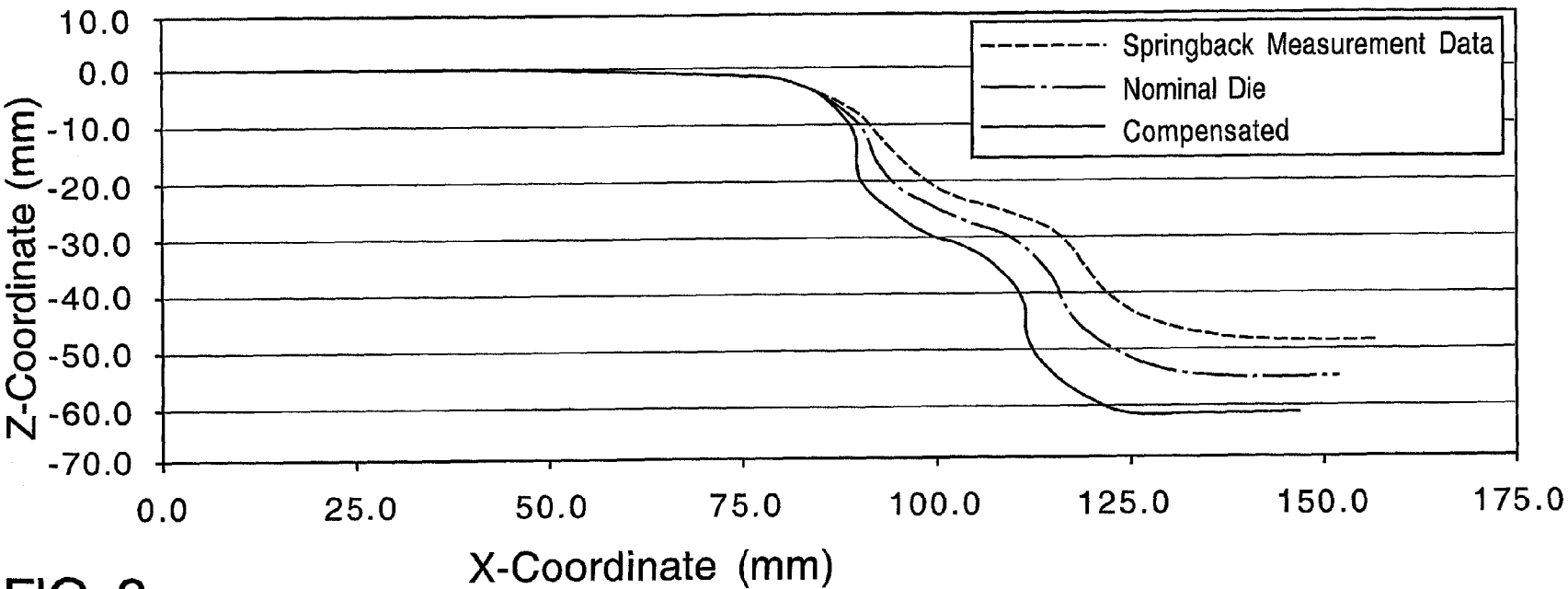
FIG. 8 is a graph showing the springback profile, nominal die profile and compensated die profile.

Correction Technique:

The shapes of the series of ten parts measured with the CMM are displayed in FIG. 7. An approximate average springback part shape was selected from the set of ten parts. This shape was used as the representative shape for the correction process. The first compensation strategy described previously, the "reversed die-normal projection technique" was used for die compensation in this demonstration. The maximum deviation measured from the nominal surface is +/−6 mm. The correction technique involved first fitting a spline to the measurement data and then placing points spaced 1.27 mm apart along the length of the profile starting from the center plane of symmetry. The same was done with the nominal shape measured from the actual die. The two profiles and associated points were aligned so the points at the center plane of symmetry both lay on the origin of the reference coordinate system. The springback results based on the process conditions used in the forming trials were generated with a computer model (FEA model) and the predicted springback shape was compared to the experimental data represented by the spline curve. The spline generated here is used to ensure that the springback comparison between the measured and the predicted part shapes are consistently and accurately represented by mathematical curves. As such errors are being minimized. Vectors relating the position of the points on the part after springback relative to their associated point on the nominal profile were calculated. These vectors were then reversed using the first strategy and their magnitudes were multiplied by some scalar constant in order to account for the over-compensation determined by FEA analysis. A trial and error technique involving the FEA analyses yielded an appropriate value of 1.15 for this scalar constant. The FEA analysis accounted for gravity and accurately modeled the fixity conditions in the CMM measurement. After the forming and springback analysis was performed with the appropriate scalar value, the shape was accurate to within 1 mm of the nominal die profile and it was measured in the direction normal to the die surface. The nominal die shape, representative part shape and compensated die shape are included in FIG. 8.

Figure 9:
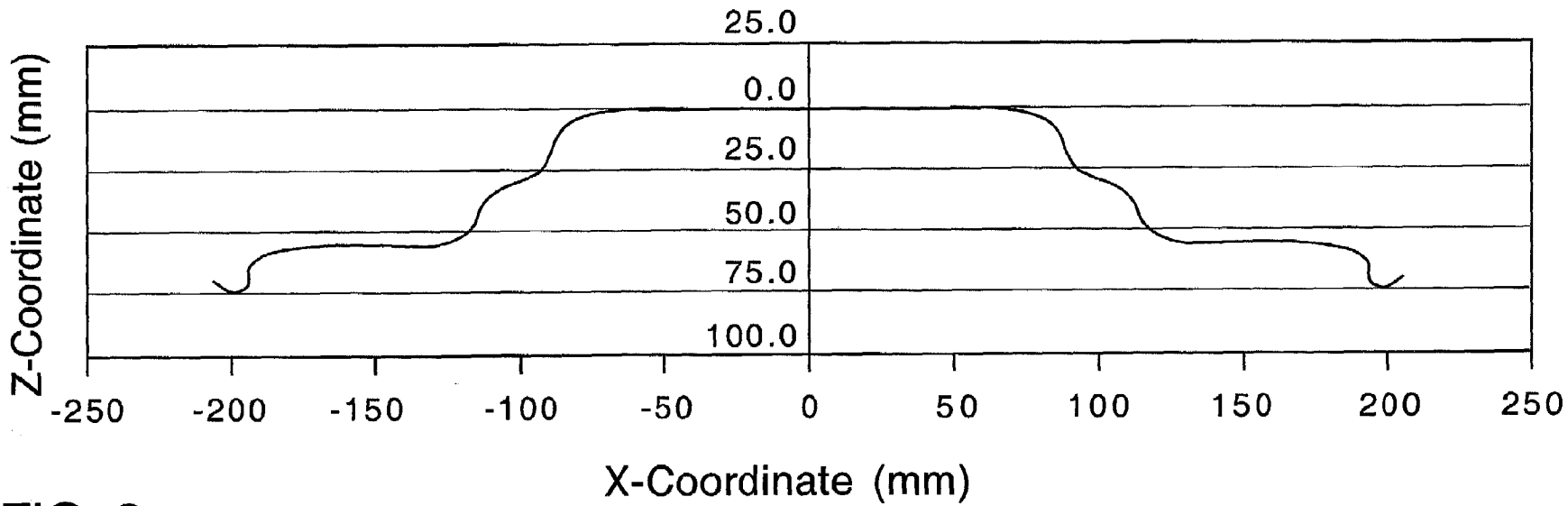
FIG. 9 is a graph showing the shape of ten parts made by the compensated die.
Figure 10:
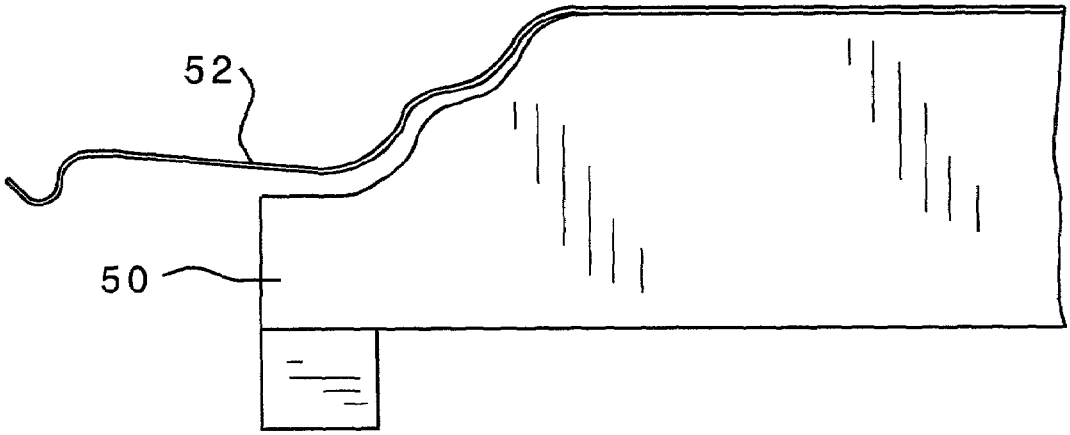
FIG. 10 shows a part made by the nominal die profile placed over the compensated die.
Figure 11:
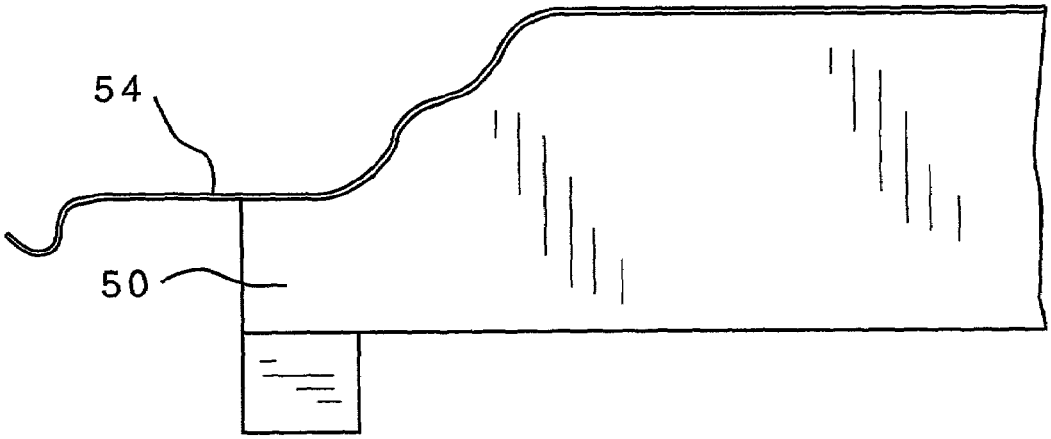
FIG. 11 shows a part made by the compensated die placed over the nominal die profile.

The new punch and die were cut to the compensated die shape predicted by the computer model and another series of parts were formed under all of the same conditions as before. The shapes of the series of ten parts measured with the CMM and formed with the compensated tools are displayed in FIG. 9. Every part was within +/−1.75 mm of nominal in the Z-direction. The local maxima are located at points where the tangent to the wall is at 72° to horizontal, thus amplifying any deviation from nominal. The deviation measured normal to the part is less than 1 mm for all parts. The overall result of this study can be found in FIGS. 10 and 11 which shows a nominal die 50 with an overlay of a part 52 made with that nominal die 50 (FIG. 10) and a part 54 made with a compensated die pursuant to the above example (FIG. 11). As can be seen, part 54 is well within the desired tolerance.

The springback compensation proved to be successful in that the deviation from nominal in the Z-direction was less than the goal of +/−2 mm and was less than 1 mm from nominal when measured in the direction normal to the part. This indicated that the geometric method of reversing the normal vectors relating points after springback to the nominal geometry proved to be successful for a prismatic part. In addition, the FEA used to determine the appropriate magnitude of this reversal proved to be accurate.

The example indicates that not only does the springback of the part radii need to be compensated for, but also the "dead" areas near inflection points. This is evident where the curvature does not change abruptly as it does with the tool surfaces. In this region, the bending deformation is not sufficient to yield the material.

The purely geometric technique used in this example is also applicable to parts with curvature in three dimensions.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breath of the appended claims and any all equivalents thereof.

What is claimed is:

1. A method of making a metal part under a set of forming conditions, said method comprising the steps of: providing a nominal die profile; determining a springback profile based on said nominal die profile; employing a compensation strategy to determine a compensated die profile based on said nominal die profile and said springback profile; making a die having a compensated die profile; employing said die to produce said metal part; determining whether a part made with a die having said springback profile is within a desired tolerance range after determining said springback profile; and employing a compensation strategy includes the following steps: (i) selecting an initial scaling factor; and (ii) employing said initial scaling factor in said compensation strategy.

2. The method of claim 1, including adjusting said initial scaling factor if more than 30% of said part is outside of said desired tolerance range.

3. The method of claim 1, wherein said initial scaling factor ranges between 1.00 and 1.20.

4. The method of claim 3, wherein said initial scaling factor is 1.15.

5. A method of making a metal part under a set forming conditions, said method comprising the steps of providing a nominal die profile; determining a springback profile based on said nominal die profile; employing a compensation strategy to determine a compensated die profile based on said nominal die profile and said springback profile; making a die having a compensated die profile; employing said die to produce said metal part, determining whether a part made with a die having said springback profile is within a desired tolerance range after determining said springback profile; and employing local scalar factors for different portions of said part.

6. The method of claim 5, including employing local scalar factors for said different portions of said part if greater than 70% of said part is within said desired tolerance range.

7. A method of making a metal part under a set of forming conditions, said method comprising the steps of: providing a nominal die profile; determining a springback profile based on said nominal die profi1e; employing compensation strategy to determine a compensated die profile based on said nominal die profile and said springback profile; making a die having a compensated die profile; employing said die to produce said metal part; wherein said compensation strategy includes one or a combination of two or more selected from the group consisting of(i) a reversed die-normal technique; (ii) a reversed radial rotation technique; (iii) a reversed resultant vector technique; (iv) a reversed path technique; and (v) a mirror image of resultant vector technique.

8. The method of claim 7, wherein said reversed die-normal technique includes the steps of: (i) calculating a length of a first normal vector from a point on said nominal die profile to a point on said springback profile; (ii) multiplying said length of said first normal vector by a scalar factor to obtain a compensated length; (iii) projecting a second normal vector having said compensated length from said point on said nominal die profile in a direction opposite said normal vector to create a point on said die profile; and (iv) repeating steps (i) through (iii) for a plurality of points on said die profile.

9. The method of claim 7, wherein said reversed radial rotation technique includes the steps of (i) providing a central origin line; (ii) creating a first radius vector having a center origin point and a first terminus point on said nominal die profile, said first radius vector being perpendicular to said central origin line, said first radius vector having a first radial length; (iii) rotating said first radius vector about said center origin point and towards said springback profile until said first terminus point intersects with said springback profile to create a second tenninus point, with said first terminus point and said second terminus point creating a first are having a first are length; (iv) multiplying said first are length by a scalar factor to determine a compensated arc length; (v) rotating said first radius vector about said center origin point from said first terminus in a direction opposite said springback profile by a magnitude equal to said compensated are length to determine a third terminus point; and (vi) repeating steps (ii) through (v) using a plurality of radius vectors having different center origin points and different terminus points to determine a plurality of different third terminus points to create said die profile.

10. The method of claim 7, wherein said reversed resultant vector technique includes the steps of: (i) providing a first position vector extending from an origin point to a first terminus point on said nominal die profile, said first position vector having a first length and said first terminus point having a corresponding second terminus point on said springback profile; (ii) providing a second position vector extending from said origin point to said second terminus point on said springback profile; (iii) calculating a first resultant vector having a resultant vector length by subtracting said first position vector from said second position vector; (iv) multiplying said resultant vector length by a sealar factor to determine a compensated resultant vector length; (v) projecting a second resultant vector having said compensated resultant vector length from said first terminus point in a direction opposite said first resultant vector to create a third terminus point on said die profile; and (vi) repeating steps (i) through (v) For a plurality of points on said die profile.

11. The method of claim 7, wherein said reversed path technique includes the steps of (i) selecting a first point on said nominal die profile; (ii) determining a corresponding second point on said springback profile; (iii) determining a first path having a first trajectory and a first distance for springback of said first point to said second point; (iv) multiplying said first distance by a scalar factor to determine a compensated first path distance; (v) reversing said first path from said nominal die profile in a direction opposite said springback profile along said first trajectory and for said compensated first path distance to create a point on said die profile; and (vi) repeating steps (i) through (v) for a plurality of points on said doe profile.

12. The method of claim 7, wherein said mirror image of resultant vector technique includes the steps of: (i) providing a first position vector extending from an origin point to a first terminus point on said nominal die profile, said first position vector having a first length and said first terminus point has a corresponding second terminus point on said springback profile; (ii) providing a second position vector extending from said origin point to said second terminus point on said springback profile; (iii) calculating a first resultant vector having a resultant vector length by subtracting said first position vector from said second position vector; (iv) multiplying said resultant vector length by a scalar factor to determine a compensated resultant vector length; (v) providing a line tangent to said first terminus point; (vi) determining an angle measurement of a first angle formed by said first resultant vector and said tangent line; (vii) projecting in a direction away from said springback profile a second resultant vector having said compensated resultant vector length from said first terminus point at an angle equal to said angle measurement of said first angle to create a third terminus point on said die profile; and (viii) repeating steps (i) through (vii) for a plurality of points on said die profile.

13. The method of claim 7 wherein said metal part is made of aluminum.

* * * * *

UNITED STATES PATENT AND TRADEMARK OFFICE

CERTIFICATE OF CORRECTION

PATENT NO. : 7,194,388 B2
APPLICATION NO. : 10/105578
DATED : March 20, 2007
INVENTOR(S) : Chu et al.

It is certified that error appears in the above-identified patent and that said Letters Patent is hereby corrected as shown below:

Claim 7, line 4, “profi1e” should be --profile--,
Claim 9, line 12, 3 places “are” should be --arc--,
Claim 9, line 17, “are” should be --arc--,
Claim 10, line 13, “sealar” should be --scalar--,
Claim 10, line 18, “For” should be --for--; and
Claim 11, line 13, “doe” should be --die--

Signed and Sealed this

Fifteenth Day of May, 2007

JON W. DUDAS
*Director of the United States Patent and Trademark Office*